US006481176B2

(12) United States Patent
Snow

(10) Patent No.: US 6,481,176 B2
(45) Date of Patent: Nov. 19, 2002

(54) STORAGE ROOF TRUSS

(76) Inventor: Jeffrey M. Snow, 3519 Westminster Way, Bloomington, IN (US) 47401

( * ) Notice: Subject to any disclaimer, the term of this patent is extended or adjusted under 35 U.S.C. 154(b) by 0 days.

(21) Appl. No.: 09/740,357

(22) Filed: Dec. 18, 2000

(65) Prior Publication Data

US 2002/0073643 A1 Jun. 20, 2002

(51) Int. Cl.[7] ..... E04C 3/17

(52) U.S. Cl. ..... 52/639; 52/90.1; 52/690; 52/692; 52/693; 52/694; 14/4; 14/13

(58) Field of Search ..... 52/639, 643, 90.1, 52/90.2, 690, 692, 693, 694; 14/3, 4, 13

(56) References Cited

U.S. PATENT DOCUMENTS

| | | | | |
|---|---|---|---|---|
| 208,155 A | * | 9/1878 | Cooley | |
| 544,215 A | * | 8/1895 | Deville | |
| 732,787 A | | 7/1903 | Scheidler | |
| 1,367,510 A | * | 2/1921 | Wilkens | |
| 2,844,852 A | | 7/1958 | West | |
| 3,473,362 A | | 10/1969 | Black et al. | |
| 3,862,533 A | * | 1/1975 | Fuss et al. | 52/643 |
| 4,437,273 A | * | 3/1984 | Helfman | 52/643 X |
| 4,439,959 A | * | 4/1984 | Helfman | |
| 5,722,210 A | | 3/1998 | Baker et al. | |

FOREIGN PATENT DOCUMENTS

| | | | | |
|---|---|---|---|---|
| CH | 265769 | * | 3/1950 | 52/639 |
| FI | 27344 | * | 4/1955 | 52/639 |
| FR | 2467931 | * | 5/1981 | 52/639 |
| FR | 2562120 | * | 10/1985 | 52/639 |
| FR | 2650019 | * | 1/1991 | 52/639 |

OTHER PUBLICATIONS

Appendix G to ANSI/TPI 1—1995 National Design Standard for Metal Plate Connected Wood Truss Construction, Copyright 1995 by the Truss Plate Institute, Madison Wisconsin.

Keith Faherty and Thomas Williamson, Editors, Wood Engineering Construction Handbook Third Edition, 1997, pp. 6.1 through 6.9, Published by McGraw Hill.

* cited by examiner

*Primary Examiner*—Robert Canfield
(74) *Attorney, Agent, or Firm*—Law Offices of Royal W. Craig

(57) ABSTRACT

Abstract: The storage roof truss has a non-triangular central opening to provide greater storage space. Truss chords and webs are arranged to provide a central opening with a horizontal bottom and vertical lower sides. This allows more usable storage space. The central opening chords and webs are connected to the top chords in a triangular mesh pattern such that loads on the element junctures are carried in tension or compression. This allows similar structural efficiency as a conventional truss. Therefore roof storage trusses can be constructed with similar costs as conventional trusses. Also, storage roof trusses can have the same range of pitches as conventional trusses.

11 Claims, 13 Drawing Sheets

STORAGE ROOF TRUSS

BACKGROUND OF THE INVENTION

This invention relates to trusses for roofs, specifically to such roof trusses that provide storage space or living space.

There are a large variety of roof truss designs. They are extensively used in residential buildings due to their relative low cost, prefabrication, and rapid installation. Trusses are planar and joined arrangements of straight structural elements, chords and webs. In residential buildings the chords or webs are usually pieces of dimension lumber, 2-by-4s or 2-by-6s. Chords are the elements on the outside edge of the truss. Webs are the elements on the interior of the truss. The most common exterior shape of a roof truss is a symmetrical or isosceles triangle. A horizontal bottom chord is on the bottom of the triangular shape. Each end of the bottom chord terminates at a heel and is joined to an inclined top chord. The top chords extend from the heel upward and toward each other and are joined at an apex. Trusses are generally supported at their heels. There are a large variety of trusses with other than symmetrical triangular exterior shapes, such as Scissors, Mono, Parallel Chord, Gambrel, Hip, etc.

Most trusses have their chords and webs arranged in triangular mesh patterns with the triangle vertices coincident with at least one other vertex (except at the heels). A triangle vertex does not terminate between the vertexes of another triangle. This is a very structurally efficient design. Loads on a triangle vertex (chord and web junctures) are resisted by compression or tension of the chords or webs forming the triangle. Loads between vertices are resisted by bending of the chord or web. For the same load this requires chords or webs with much larger cross sections. The arrangement of triangles with coincident vertexes causes loads to be transferred via compression or tension of the chords or webs. Chords support live and dead loads such as wind, snow, roof or ceiling membrane weight etc. The loads on the chords are transferred to the junctures between chords and webs.

The "Wood Engineering and Construction Handbook, 3$^{rd}$ Ed." by Faherty and Williamson shows 34 typical trusses (on pages 6.7 and 6.8). All but three of these truss designs have a triangular mesh pattern of their webs and chords. One of the three is a Gable End which is continuously supported on its bottom cord and therefore is not a load carrying roof truss. The second of the three is an Attic truss, its' limitations are discussed below. The third of the three is called a FlorTrus™. The FlorTrus is a flat truss (parallel top and bottom chords) with a small central rectangular opening. The opening is to allow passage of heating and cooling air ducts. The bending loads in the top and bottom chords around the opening are tolerable because of the small span of the opening. This design is not suitable for a storage space.

"Appendix G of ANSI/TPI 1-1995 National Design Standard for Metal Plate Connected Wood Truss Construction" shows 42 types of trusses. All but five of these truss designs have a triangular mesh pattern of their webs and chords. One of the five is a Gable End, as described above, which is continuously supported on its bottom cord and therefore is not a load carrying roof truss. The second of the five is a Room-in-Attic truss, which is the same as the Attic truss discussed above. The limitations of the Room-in-Attic or Attic truss are discussed below. The third of the five is called a Warren truss. This truss is identical to the FlorTrus described above. The Warren truss is a flat truss (parallel top and bottom chords) with a small central rectangular opening. The opening is to allow passage of heating and cooling air ducts. The bending loads in the top and bottom chords around the opening are tolerable because of the small span of the opening. This design is not suitable for a storage space. The fourth of the five is a Fan or Modified Warren truss. This truss is a Warren truss with additional vertical webs, its' limitations are the same as the Warren truss. The fifth of the five is a "Double Cantilever with Parapets". The design is a flat truss with sloped cantilevered ends that form parapets. This truss has a triangular mesh pattern of webs and chords except above the support points. At this location a triangle vertex terminates on another triangles' side rather than its' vertex. This design is not suitable for storage space.

Toothed metal connector plates or truss plates such as shown in U.S. Pat. Nos. 2,844,852 to West and 3,473,362 to Black et al are commonly used to connect wood truss elements. The plates are place on each side of a joint with the teeth facing the wood and then pressed in. This forms a strong and very compact joint. Prior to truss plates plywood gussets were used. Plywood gussets were placed on both sides of the joint then glued and nailed to the chords and webs. Pins can form joints such as shown in U.S. Pat. No. 5,722,210 to Baker et al.

U.S. Pat. No. 732,787 to Scheidler shows the frame for a barn with a large central opening with vertical lower sides. The roof is gambrel shaped, the upper portion has less pitch or slope than the lower portion. The barn sides, the lower and steeper roof portion, and the lower half of the upper roof portion are supported by a triangular mesh pattern of webs and chords. The top chords of the upper roof cantilever out from the triangular mesh and are joined at the apex. There is no bottom chord to tie the sides together. This design could not be used as a roof truss.

The most common truss used in residential construction is the fink or W truss shown in FIG. 11. The W truss has a large triangular central opening 36 with a horizontal bottom chord 26 and a pair of apex webs 30 forming the sides. Decking material can be placed over the horizontal bottom chord of the triangular patterns of several trusses forming a storage space. Other truss configurations have horizontal bottom elements or chords and can be used to form a storage space. However, a W type of truss has the largest possible triangular space with a horizontal bottom element for the same width and height of truss.

Low overhead usually limits this space to storage versus a living space. The sloping sides of the triangle limit usable storage space. Items with any height cannot be pushed to the comers of the triangle. The center of the triangle is normally kept clear to provide a path or passageway to the stored items. The path limits the usable storage space. The steep slope of these sides makes the path or passageway feel smaller which inhibits usage. People feel confined and therefore are less likely to use the space.

An Attic truss shown in FIG. 12 provides storage or living space. The center opening 36 is defined by a bottom chord 26, vertical webs 28, portions of the top chords 22, and a cross web 42. The vertical lower sides, provide by the vertical webs, greatly add to the usable space. FIG. 13 shows another version of the Attic truss, sometimes called Room-in-Attic truss. The center opening 36 is defined by a horizontal bottom chord 26, a cross chord 56, and vertical webs 28. The chords and webs for either type of attic truss do not have the required triangular mesh pattern for greatest structural efficiency. The chords must carry significant joint loads via bending and therefore must be of greater cross section.

Larger spans of the either type of Attic truss require much greater cross section of the chords, therefore this design is usually only seen in shorter span designs. To provide adequate headroom both types of Attic trusses must have steeply inclined top chords.

BRIEF SUMMARY OF THE INVENTION

Truss elements, chords and webs, are arranged to provide a central opening with a horizontal bottom and vertical lower sides. This allows more usable storage space. The central opening chords and webs are connected to the top chords with webs and chords forming triangular mesh patterns such that loads on the chord and web junctures are carried in tension or compression. Therefore structural efficiency and cost is similar to a conventional truss.

OBJECT AND ADVANTAGES

The storage roof truss provides a large usable storage space within the trusses. Flooring or decking placed across the horizontal bottom chord of multiple trusses provides storage space. The vertical lower sides of the storage truss's central opening provide usable space over the entire decked area. A prior art Attic truss provides storage or living space. The Attic truss requires top chords with a high pitch or large incline and larger cross sections of top and bottom chords. Loads placed on the attic truss junctures are not carried principally in tension or compression of the chords but are carried as moment or bending loads therefore chord cross sections must be larger. The triangular mesh pattern of storage roof truss chords and webs between the central opening and the top chords cause loads placed on the element junctures to be carried in tension or compression. This is the same structural efficiency that conventional trusses have. Therefore truss chords with small cross sections can be used allowing low cost.

REFERENCE NUMERALS

Figure 1:
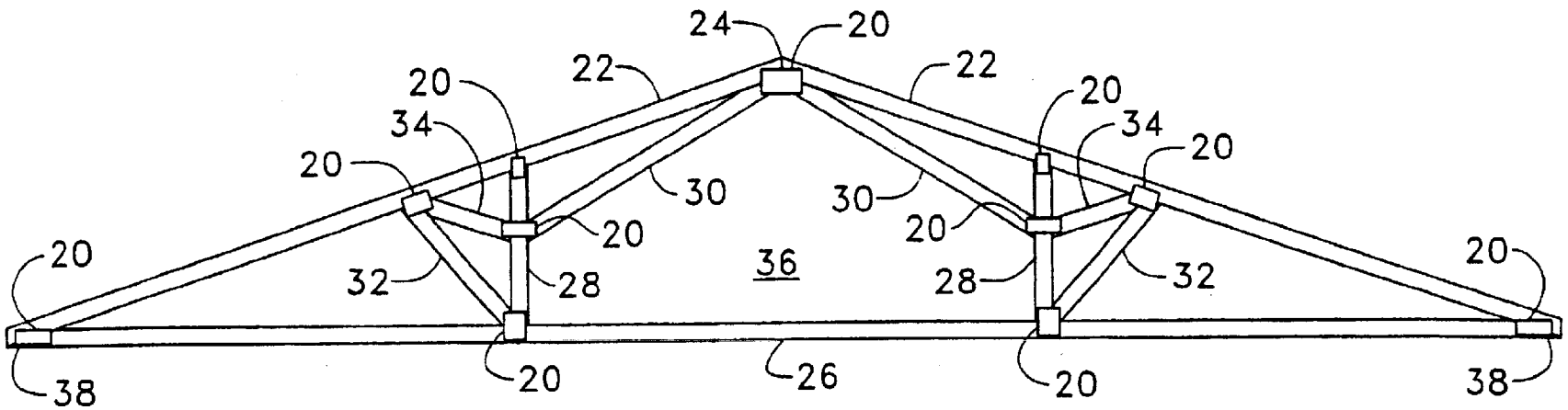
FIG. 1 shows a front view of the invention with truss plates shown

20 truss plate
22 top chord
24 apex
26 bottom chord
28 vertical web
30 apex web
32 outboard web
34 brace web
36 central opening
38 heel
42 heel web
44 outer bottom chord
46 triangle mesh pattern
48 vertical chord
50 inclined side chord
52 thicker center bottom chord
54 half W truss
56 cross web

DETAILED DESCRIPTION OF THE INVENTION

Preferred Embodiment

Figure 2:
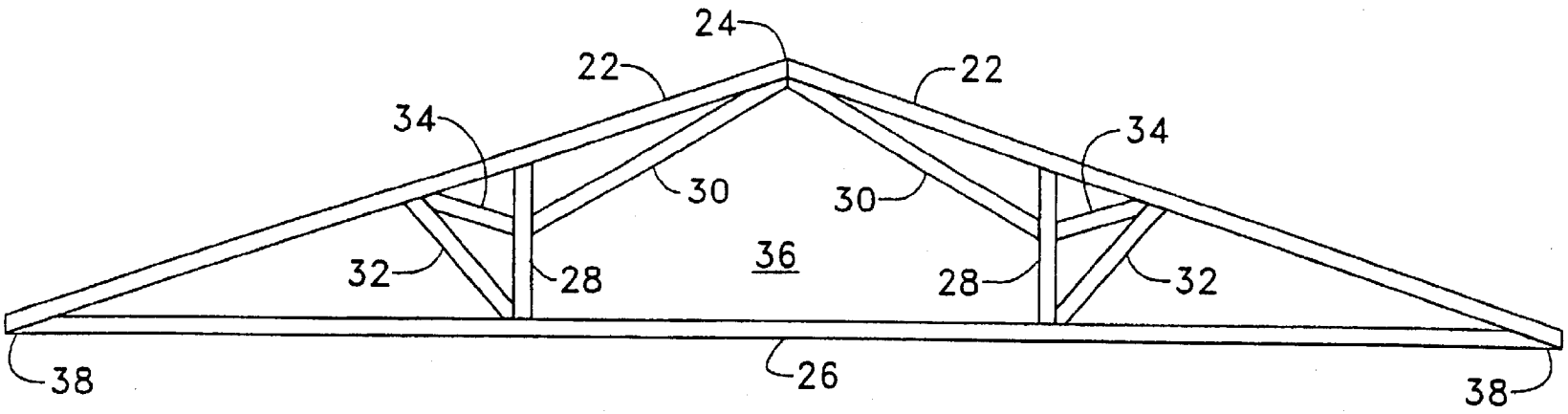
FIG. 2 shows a front view of the invention with truss plates not shown

FIGS. 1 and 2 show the preferred embodiment of the storage roof truss. FIG. 1 shows the storage roof truss with truss plates 20. For clarity, FIG. 2 shows the storage roof truss without the truss plates 20. The truss is made of chords and webs arranged in a plane and connected together by truss plates 20. A chord or web is a straight piece of lumber or composite material. Pieces used on the outside edges of the truss are called chords, and pieces used on the interior of the truss are called webs. Truss plates 20 are toothed metal connector plates commonly used to join chords and webs in most wooden trusses. Truss plates have teeth on only one side. A truss plate is placed on each side of a chord and web joint with the teeth facing the wood. The plates are pressed into the wood, forming a largely flush connection or juncture between the abutting wood pieces.

A pair of top chords 22 are joined at an apex 24. The far ends of the top chords 22 are joined to a bottom chord 26 at heels 38 forming a triangle. A vertical web 28 joins each top chord 22 at an intermediate point on the top chord. Both vertical webs 28 extend downward and join the bottom chord 26. An apex web 30 joins each vertical web 28 at an intermediate point then extends up and over to join the top chords 22 substantially at the apex 24. This arrangement forms a central opening 36 with a horizontal bottom and vertical lower portions of the sides.

There is a pair of outboard webs 32. Each outboard web 32 joins the bottom chord 26 and one of the two vertical webs 28 substantially at the juncture of the chord and vertical web. The outboard web 32 extends up and away from the vertical web 28 and joins a top chord 22. The juncture with the top chord 22 is at an intermediate point between the heel 38 and juncture of the top chord 22 with the vertical web 28. There is a pair of brace webs 34. Each brace web 34 joins a outboard web 32 and top chord 22 substantially at their juncture. The brace web 34 extends and joins the vertical web 28, at a point substantially opposite the vertical webs' juncture with the apex web 30. This arrangement provides a triangular mesh of webs and chords between the top chords 22 and the central opening 36. The triangular mesh coupled with the bottom chord allows loads placed on any juncture to be carried mostly in tension or compression of the webs and chords. Loads such as wind, roof, snow, or ceiling loads are carried by the top and bottom chords to the chord and web junctures.

Operation

Decking or flooring material is placed over the portion of the bottom chord 26 between the vertical webs 28 of multiple trusses forming a storage space. If the central opening 36 is sufficiently large a living space may be formed.

Other Embodiments

In all figures after FIG. 1 truss plates are not shown to improve clarity of the figures. Truss plates 20 (or some other method of joining chords and webs) are required at each juncture of chords and webs.

Figure 3:
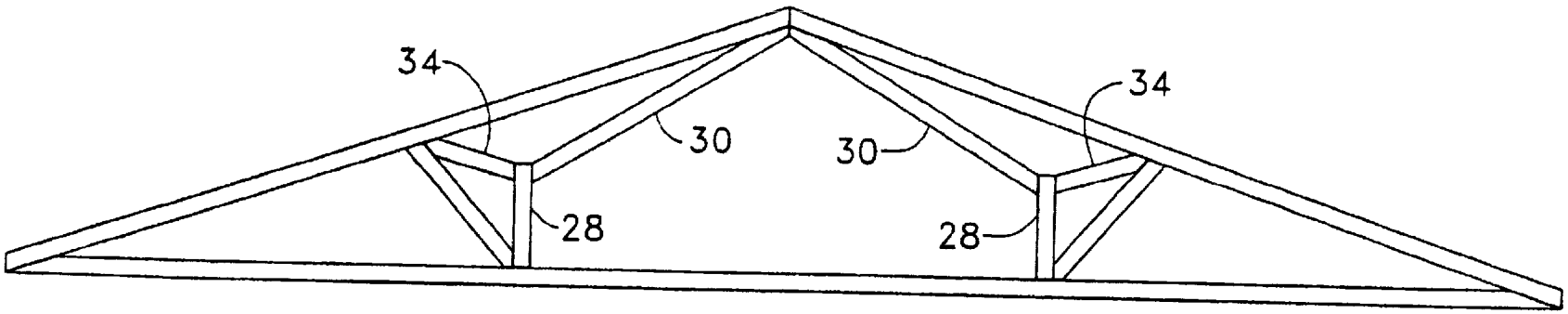
FIG. 3 shows a front view of an additional embodiment with truncated vertical webs, with truss plates not shown

An additional embodiment is shown in FIG. 3. The vertical webs 28 are truncated and do not extend upward past their juncture with the apex web 30 and brace web 34.

Figure 4:
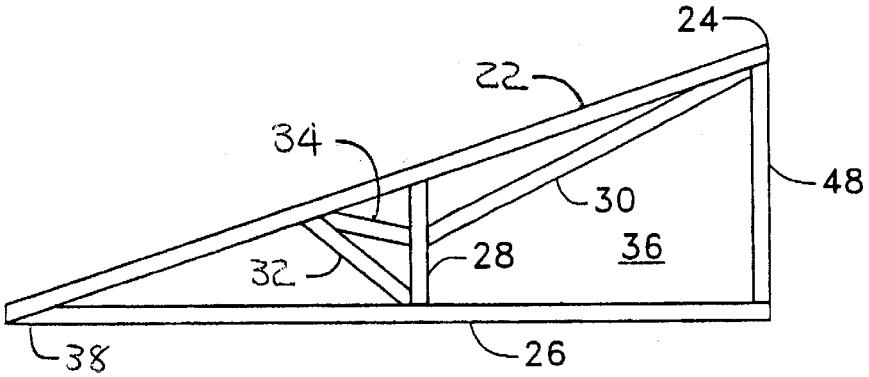
FIG. 4 shows a half truss connected to a vertical chord, with truss plates not shown
Figure 5:
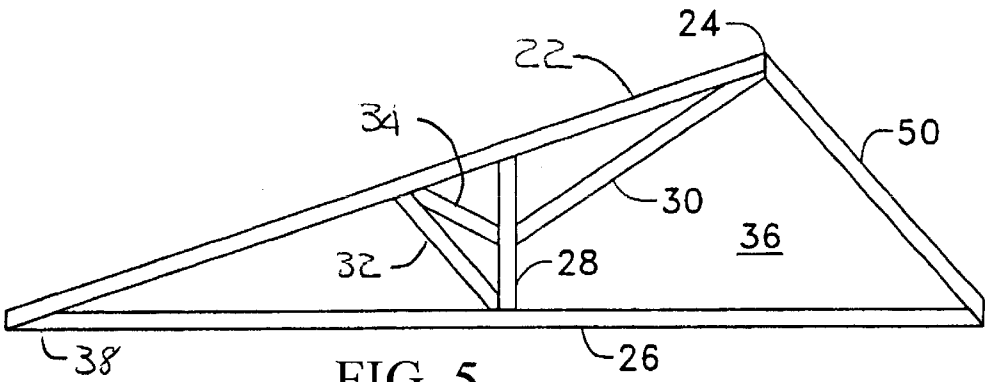
FIG. 5 shows a half truss connected to an inclined chord, with truss plates not shown
Figure 6:
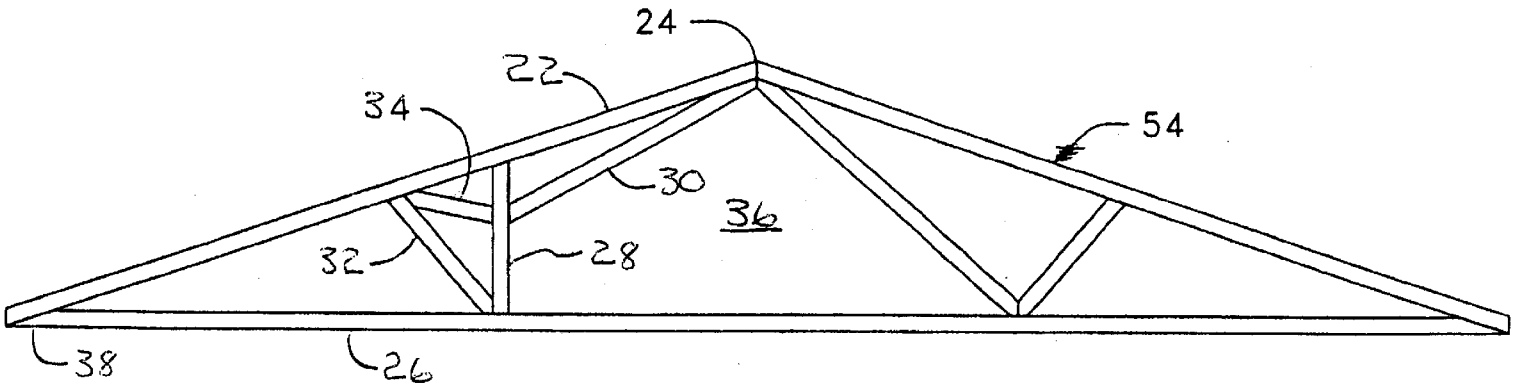
FIG. 6 shows a half truss connected to half of a conventional truss, with truss plates not shown FIG. 7 show a truss with a thicker bottom center chord, with truss plates not shown
Figure 11:
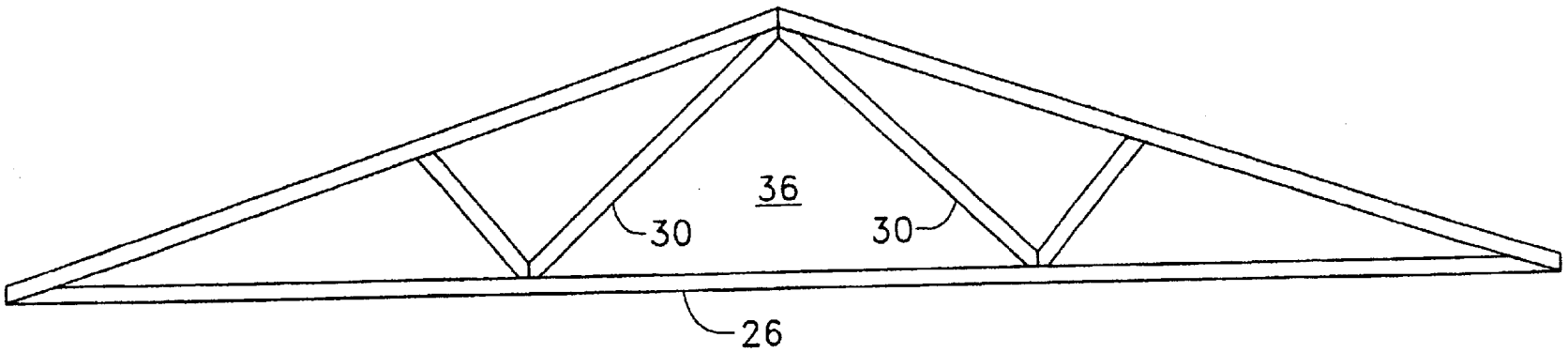
FIG. 11 (Prior Art)
FIG. 11 shows a prior art conventional W or Fink truss, with truss plates not shown
Figure 12:
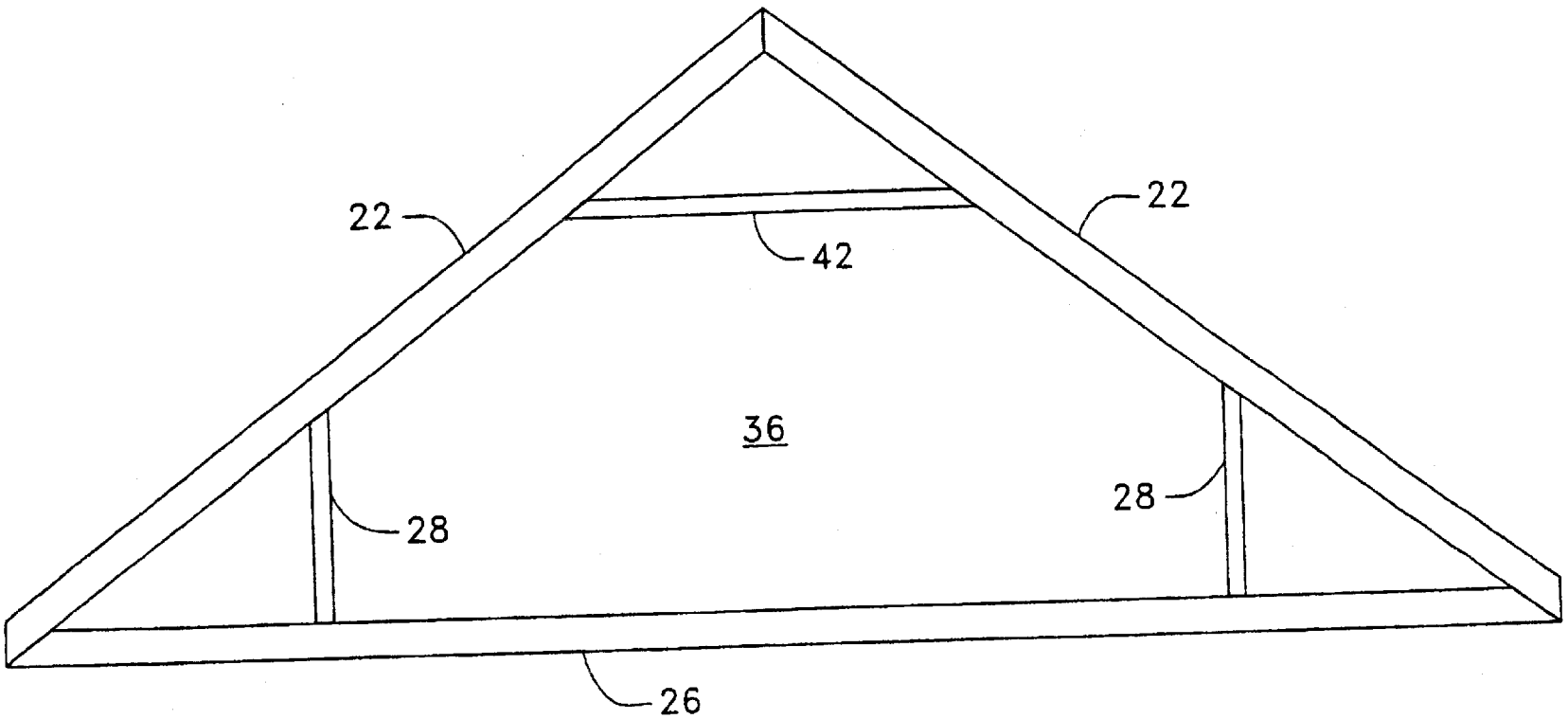
FIG. 12 (Prior Art)
FIG. 12 shows a prior art Attic truss, with truss plates not shown
Figure 13:
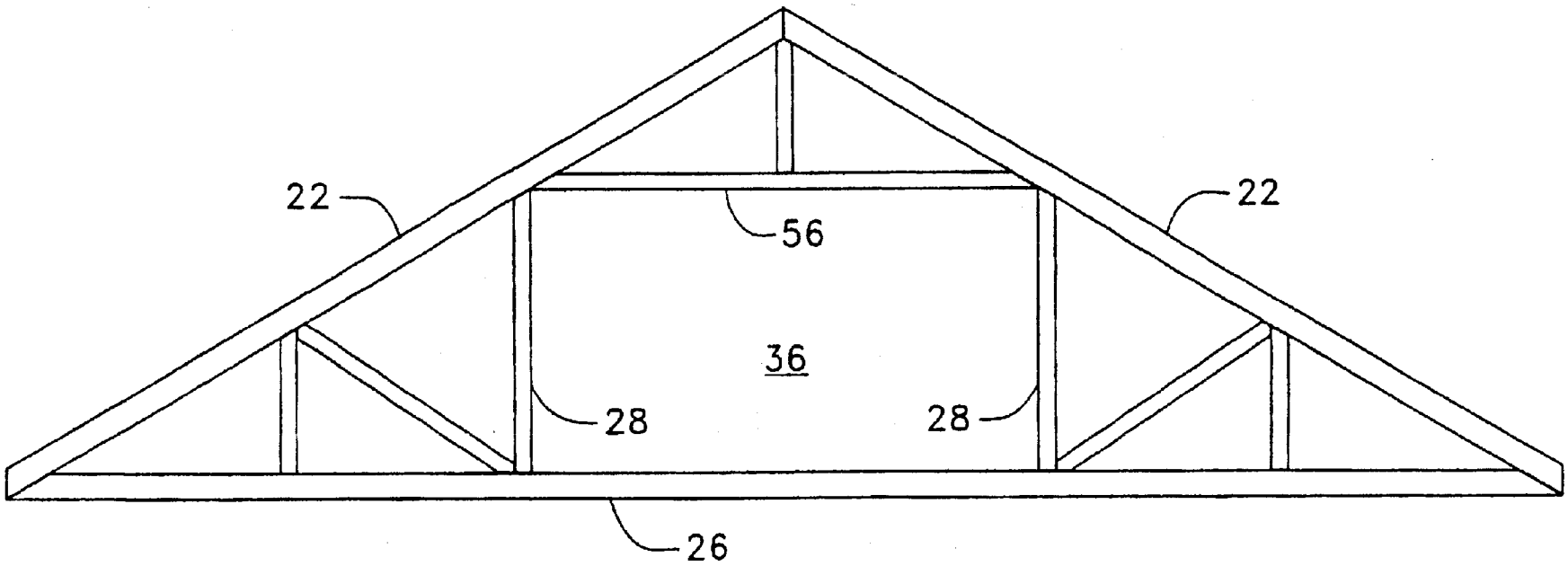
FIG. 13 (Prior Art)
FIG. 13 shows a prior art Room-in-Attic truss, with truss plates not shown

FIG. 4 shows an additional embodiment. Half of the storage roof truss to one side of the apex 24 is replaced with a vertical chord 48. The central opening 36 is defined by the bottom chord 26, the lower portion of the vertical webs 28, the apex chord 30 and the vertical chord 48. FIG. 5 shows half of the storage roof truss to one side of the apex 24 replaced with an inclined side chord 50. The bottom of the inclined side chord 50 is joined to an extension of the bottom chord 26. The central opening 36 is defined by the bottom chord 26, the lower portion of the vertical webs 28, the apex chord 30 and the inclined side chord 50. FIG. 6 shows half of the storage roof truss to one side of the apex 24 replaced with a half W truss 54. FIG. 11 shows a conventional W truss.

Figure 7:
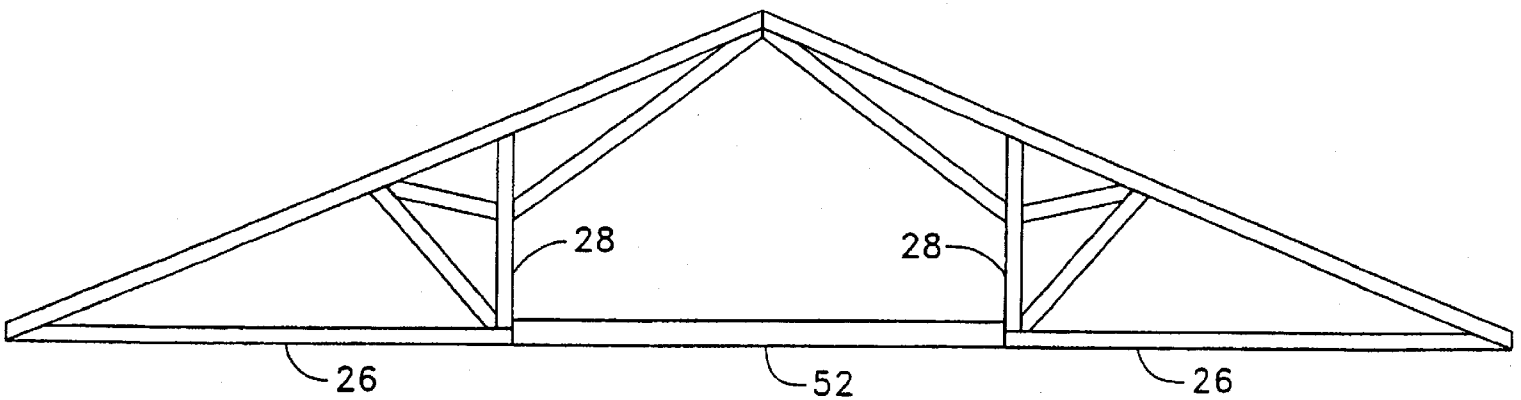

FIG. 7 shows an additional embodiment of a thicker center bottom chord 52. The portion of the bottom chord 26 between the vertical webs 28 is replaced with a chord of greater cross section. This provides greater stress and deflection resistance to storage loads. This also provides greater space for insulation between flooring material laid over the bottom chord 26 and ceiling material attached to the underside of the bottom chord.

Figure 8:
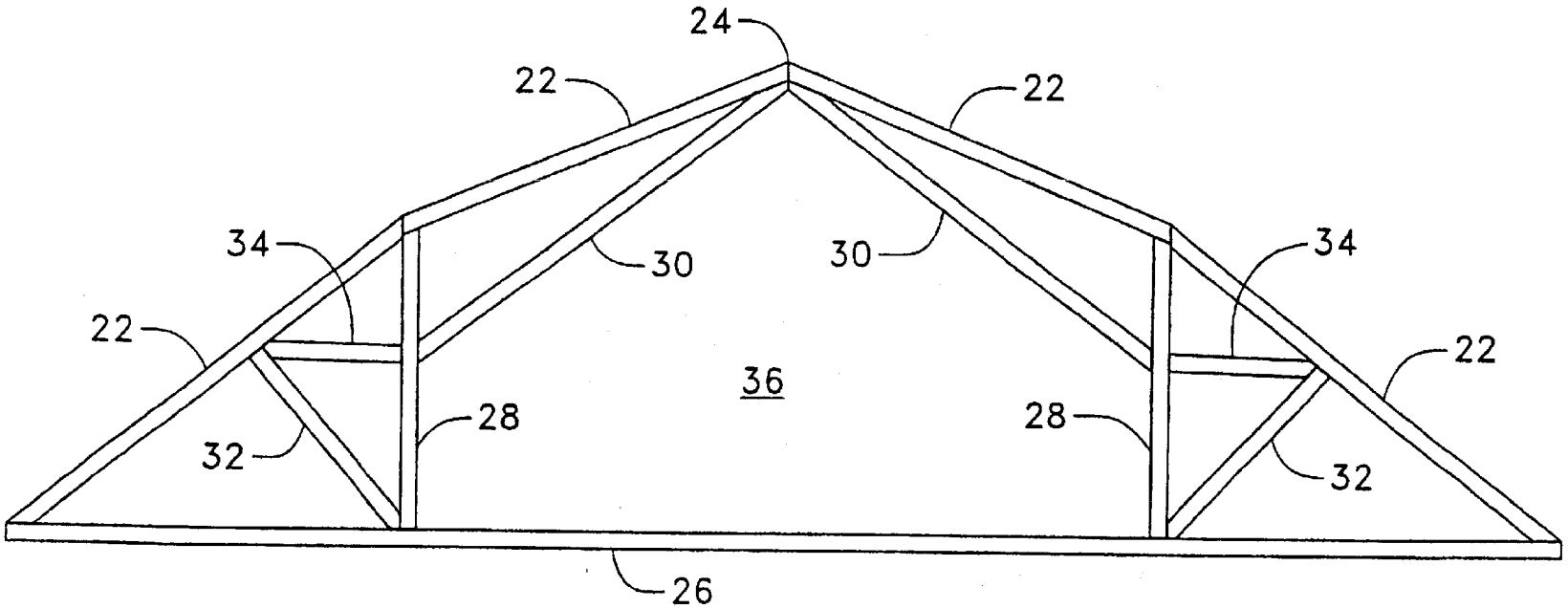
FIG. 8 shows a gambrel storage roof truss, with truss plates not shown

A gambrel roof is an additional embodiment shown in FIG. 8. Each top chord 22 consists of two straight segments with different inclines. The segments join substantially at the juncture with the vertical web 28. The top chords 22 have a lesser incline between the vertical web 28 and the apex 24. Otherwise the apex webs 30, brace webs 34, and outboard webs 32 are arranged and joined as in the preferred embodiment. The central opening 36 is defined by the bottom chord 26, the lower portion of the vertical webs 28, and the apex chords 30.

Figure 9:
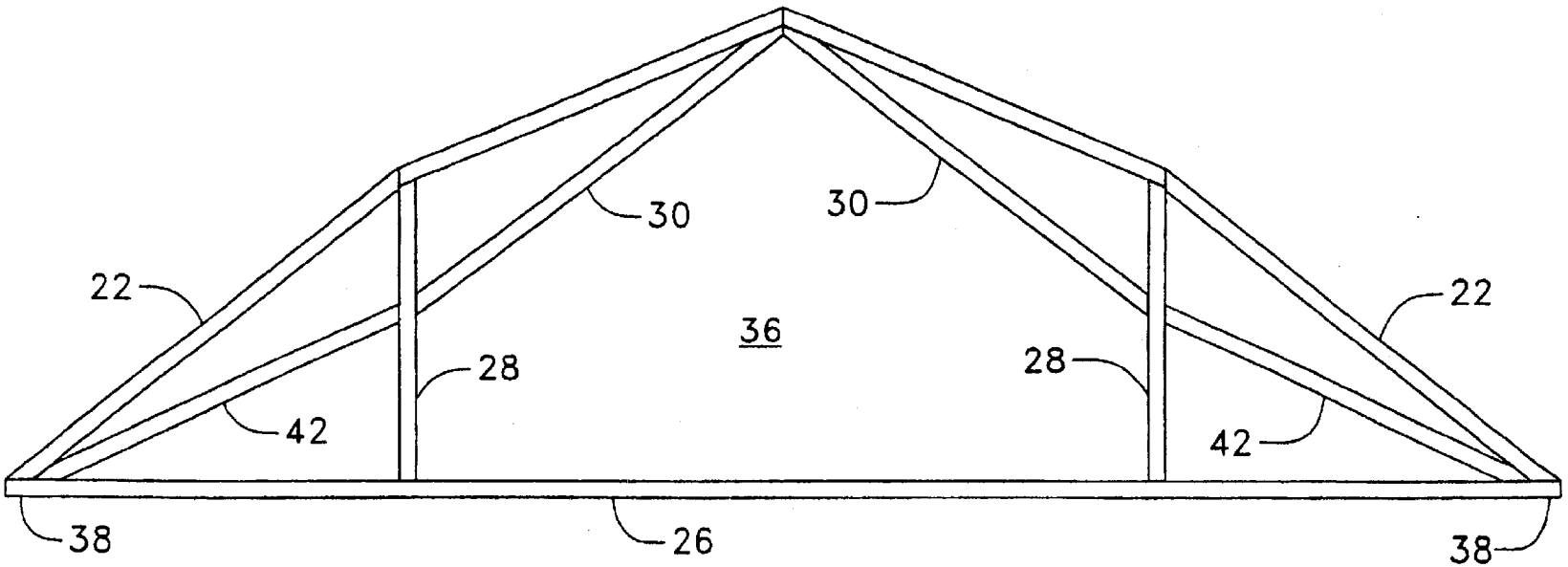
FIG. 9 shows an additional embodiment of the gambrel storage roof truss, with truss plates not shown

A variation of the gambrel roof truss design is shown in FIG. 9. Brace webs 34 and outboard webs 32, shown in FIG. 8, are replaced by heel webs 42. The heel web 42 is joined to the vertical web 28 substantially opposite from the vertical web's juncture with the apex web 30. The heel web extends to the heel 38 and joins the bottom chord 26 and the top chord 22 substantially at their juncture.

Figure 14:
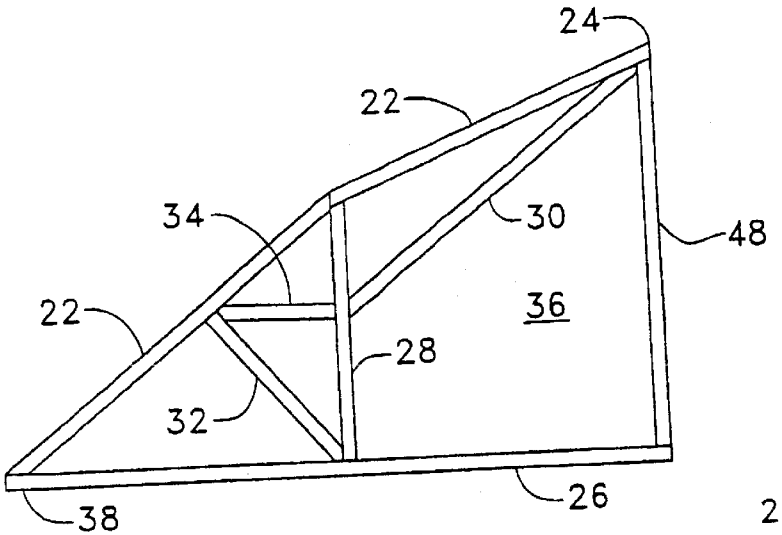
FIG. 14 shows a gambrel half truss connected to a vertical chord, with truss plates not shown
Figure 15:
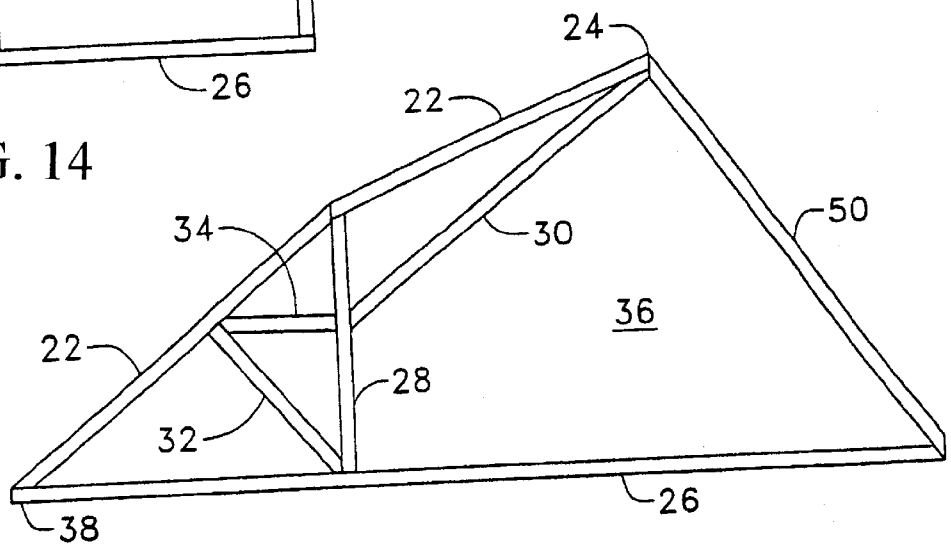
FIG. 15 shows a gambrel half truss connected to an inclined chord, with truss plates not shown
Figure 16:
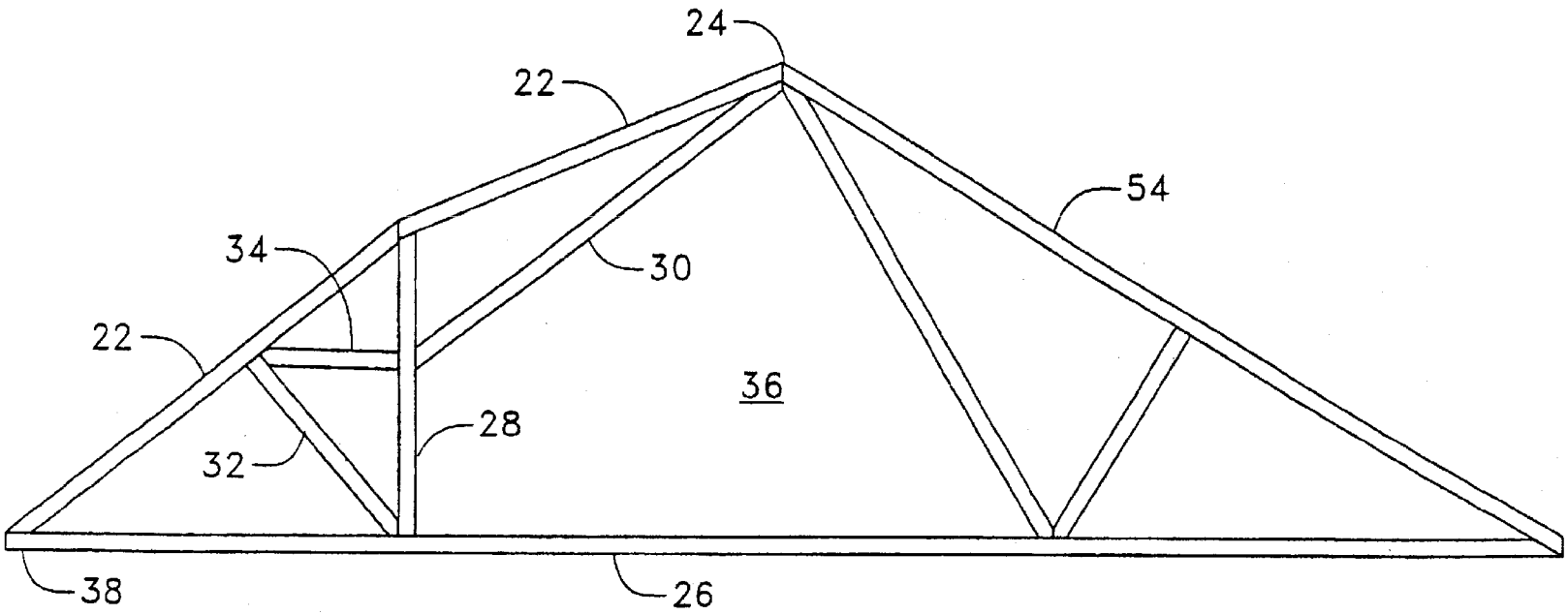
FIG. 16 shows a gambrel half truss connected to half of a conventional truss, with truss plates not

Additional embodiments are combining half of the gambrel roof storage truss shown in FIG. 8 with, a vertical chord shown in FIG. 14, an inclined chord shown in FIG. 15, or half of a conventional truss shown in FIG. 16. Another embodiment is a thicker center portion of the horizontal chord 26. The portion of the horizontal chord 26 between the vertical webs 28 is of greater cross section. This provides greater stress and deflection resistance to storage loads.

Figure 10:
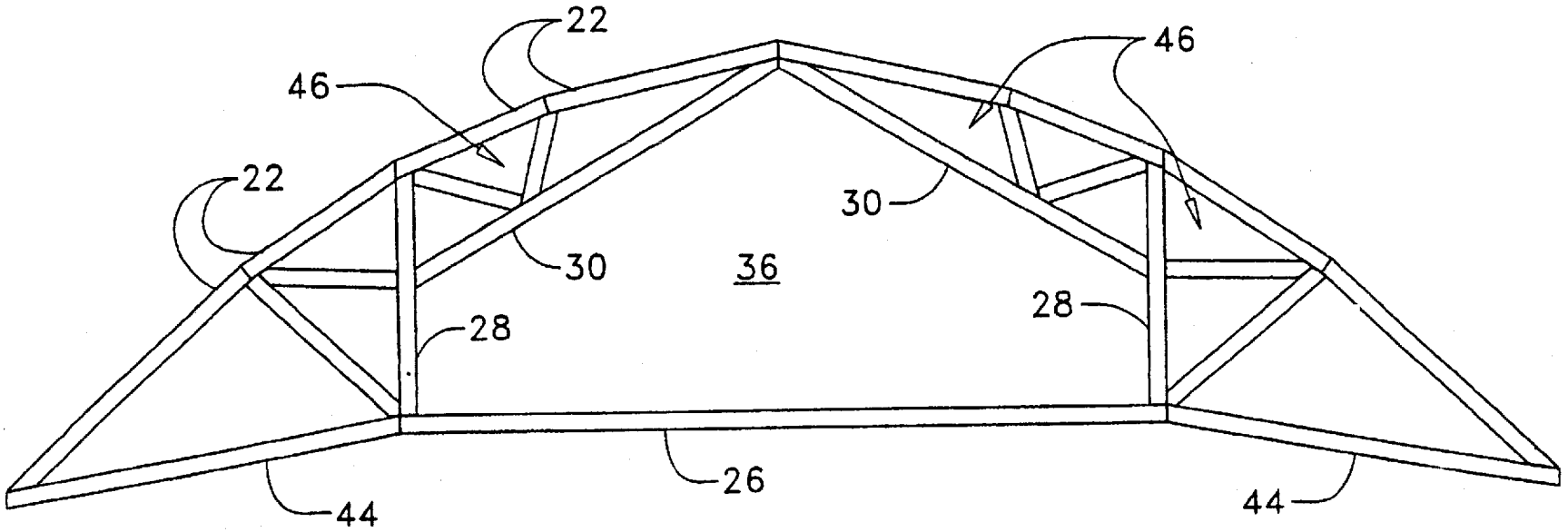
FIG. 10 shows triangular mesh between central opening and top inclined chords, with truss plates not shown

FIG. 10 shows an additional embodiment of multiple bends in the top chords 22 and bottom chord 26. As with the preferred embodiment the center opening is formed by the center portion of the bottom chord 26, lower portions of the vertical webs 28, and the apex webs 30. The center opening webs and chords are connected by webs and chords in a triangular mesh pattern 46 to the top chords 22 and other portions of the bottom chord 26.

Conclusion, Ramifications, and Scope

Accordingly, the reader will see that the truss design of this invention can be used to provide storage space at low cost. Otherwise unused or poorly used space inside roof trusses may be used for storage or living space. The storage roof truss has the same type of high structural efficiency as conventional trusses and therefore costs are similar. This truss can be made with the same range of pitches (roof slope) as conventional trusses. Attic trusses are the only other truss design that provides storage or living space. They are not as structurally efficient and therefore have greater cost. Also, attic trusses have pitch restrictions.

Although the description above contains many specificities, these should not be construed as limiting the scope of the invention but as merely providing illustrations of some of the presently preferred embodiments of this invention. For example junctures between webs and chords may be accomplished by other than truss plates such as nailed plywood gussets or pinned connections, webs and chords may be of metal or composite material, the apex web may have one or more bends in it, trusses may have asymmetric shapes such as different inclines or pitches on different side of the apex, apex webs may have an upper termination with intermediate webs rather than the top chords at the apex, etc.

Thus the scope of the invention should be determined by the appended claims and their legal equivalents, rather than by the examples given.

I claim:

1. A storage roof truss with greater storage space capacity or possible living space, comprising:

a bottom chord, a pair of upper top chords, and a pair of lower top chords; said upper top chords being joined at an apex, each said lower top chord being joined to distal end of a separate said upper top chord and said bottom chord joins each distal end of said lower top chords at a heel forming a generally gambrel roof shape;

a pair of vertical webs, each said vertical web located on horizontally opposite sides of said apex, each said vertical web joins said upper top chord and said lower top chord at their juncture and extends substantially vertically downward and joins said bottom chord;

a pair of apex webs, each said apex web joins a separate said vertical web at an intermediate point on said vertical web, said apex webs extend to said apex and join said upper top chords at said apex;

a pair of outboard webs, each said outboard web joins said bottom chord and a separate said vertical web at their juncture and extends and joins said lower top chord at an intermediate point on said lower top chord;

a pair of brace webs, each said brace web joins a separate said vertical web and said apex web at their juncture and extends and joins said lower top chord and said outboard web at their juncture;

wherein chords or webs are substantially straight and elongated structural elements and are arranged substantially in a plane;

whereby a central opening is formed with a horizontal bottom and portions of its sides being substantially vertical allowing greater storage space and any load applied at any juncture of chords or webs will be carried to said heels mostly via axial loads on the chords and webs thereby allowing small cross sections of webs and chords.

2. The storage roof truss of claim 1 wherein: the portion of said bottom chord between said pair of vertical webs is of greater cross section;

whereby stresses and deflections in said bottom chord due to storage or live loads will be less.

3. A storage roof truss with greater storage space capacity or possible living space, comprising:

a bottom chord and a pair of top chords, said top chords being joined at an apex, and said bottom chord joins each distal end of said top chords at a heel forming a generally triangular shape;

a pair of vertical webs, each said vertical web located on horizontally opposite sides of said apex, each said vertical web joins said bottom chord between the chord end and a point vertically below said apex, said vertical webs extend substantially vertically upward but not to said top chord;

a pair of apex webs, each said apex web joins a separate said vertical web at the upper end of said vertical web, said apex webs extend to said apex and join said top chords substantially at said apex;

a pair of outboard webs, each said outboard web joins said bottom chord and a separate said vertical web substantially at their juncture and extends and joins said top chord at an intermediate point between adjacent said heel and a point on said top chord located above said vertical web;

a pair of brace webs, each said brace web joins a separate said vertical web and said apex web substantially at their juncture and extends and joins said top chord and said outboard web substantially at their juncture;

wherein chords or webs are substantially straight and elongated structural elements and are arranged substantially in a plane;

whereby a central opening is formed with a horizontal bottom and portions of its sides being substantially vertical allowing greater storage space and any load applied at any juncture of chords or webs will be carried to said heels mostly via axial loads on the chords and webs thereby allowing small cross sections of webs and chords.

4. The storage roof truss of claim 3 further including:

said vertical webs extend substantially vertically upward and join said top chords, juncture of said apex webs and said brace webs is at an intermediate point on said vertical webs.

5. The storage roof truss of claim 1 wherein: the portion of said bottom chord between said pair of vertical webs is of greater cross section;

whereby stresses and deflections in said bottom chord due to storage or live loads will be less.

6. A storage roof truss with greater storage space capacity of possible living space, comprising:

a bottom chord, a top chord, and a vertical chord, said top chord being joined to said vertical chord at an apex, and said bottom chord joins distal end of said top chord at a heel, and said top chord joins distal end of said vertical chord forming a generally right triangular shape;

a vertical web joining said bottom chord and extending substantially vertically upward and joining said top chord;

an apex web joining said vertical web at an intermediate point and extending to said apex and joining said top chord and said vertical chord substantially at their juncture;

a outboard web joining said bottom chord and said vertical web substantially at their juncture, said outboard web extends and joins said top chord at an intermediate point between said heel and juncture of said vertical web and said top chord;

a brace web joining said vertical web substantially at juncture of said vertical web and said apex web, said brace web extends and joins said top chord and said outboard web substantially at their juncture;

wherein chords or webs are substantially straight and elongated structural elements and are arranged substantially in a plane;

whereby a central opening is formed with a horizontal bottom and portions of its sides being substantially vertical allowing greater storage space and any load applied at any juncture of chords or webs will be carried to said heel and juncture of said bottom chord and said vertical chord mostly via axial loads on the chords and webs thereby allowing small cross sections of webs and chords.

7. The storage roof truss of claim 6 wherein: said vertical chord is inclined becoming an inclined side chord.

8. The storage roof truss of claim 6 wherein: said vertical chord is replaced with a half of a conventional W truss.

9. The storage roof truss of claim 6 wherein: said top chord consists of two segments with different inclines, said segments join substantially at juncture with said vertical web forming a generally half gambrel roof shape.

10. The storage roof truss claim 9 wherein: said vertical chord is inclined becoming an inclined side chord.

11. The storage roof truss claim 9 wherein: said vertical chord is replaced with a half of a conventional W truss.

* * * * *